US010081853B2

(12) United States Patent
Wilks et al.

(10) Patent No.: US 10,081,853 B2
(45) Date of Patent: Sep. 25, 2018

(54) CORRODIBLE DOWNHOLE ARTICLE

(71) Applicant: Magnesium Elektron Limited, Manchester (GB)

(72) Inventors: Timothy E. Wilks, Manchester (GB); Mark Turski, Manchester (GB); Matthew Murphy, Manchester (GB)

(73) Assignee: Magnesium Elektron Limited, Manchester (GB)

( * ) Notice: Subject to any disclaimer, the term of this patent is extended or adjusted under 35 U.S.C. 154(b) by 0 days.

(21) Appl. No.: 15/865,768

(22) Filed: Jan. 9, 2018

(65) Prior Publication Data

US 2018/0202027 A1 Jul. 19, 2018

(30) Foreign Application Priority Data

Jan. 16, 2017 (GB) ..... 1700714.7

(51) Int. Cl.

| | |
|---|---|
| ***C22C 23/06*** | (2006.01) |
| ***B22D 21/00*** | (2006.01) |
| ***C22C 1/03*** | (2006.01) |
| ***C22C 30/00*** | (2006.01) |
| ***C22F 1/06*** | (2006.01) |
| ***E21B 33/12*** | (2006.01) |
| ***E21B 34/00*** | (2006.01) |

(52) U.S. Cl.

CPC ..... *C22C 23/06* (2013.01); *B22D 21/007* (2013.01); *C22C 1/03* (2013.01); *C22C 30/00* (2013.01); *C22F 1/06* (2013.01); *E21B 33/12* (2013.01); *E21B 34/00* (2013.01)

(58) Field of Classification Search

CPC ..... C22C 23/06

See application file for complete search history.

(56) References Cited

U.S. PATENT DOCUMENTS

| | | | | |
|---|---|---|---|---|
| 6,230,799 | B1 * | 5/2001 | Slaughter ..... | E21B 28/00 166/177.2 |
| 2005/0279427 | A1 | 12/2005 | Park et al. | |
| 2011/0229365 | A1 | 9/2011 | Lyon et al. | |
| 2016/0024619 | A1 | 7/2016 | Wilks et al. | |
| 2016/0201435 | A1 | 7/2016 | Fripp et al. | |
| 2016/0230494 | A1 | 8/2016 | Fripp et al. | |
| 2018/0010217 | A1 | 1/2018 | Wilks et al. | |

FOREIGN PATENT DOCUMENTS

| | | | |
|---|---|---|---|
| CN | 105779796 | A | 7/2016 |
| CN | 106086559 | A | 11/2016 |
| FR | 2296698 | A1 | 7/1976 |
| GB | 2529062 | A | 11/2017 |
| JP | H10147830 | A | 6/1998 |
| WO | WO2004/001087 | A1 | 12/2003 |

OTHER PUBLICATIONS

U.S. Appl. No. 15/865,776, filed Jan. 9, 2018, entitled Corrodible Downhole Article, Inventor Timothy E. Wilks, et al.

Combined Search & Examination Report for GB1700714.7 dated Jun. 15, 2017, 8 pages.

International Search Report and Written Opinion for PCT/GB2018/050038 dated Mar. 14, 2018, 14 pages.

* cited by examiner

*Primary Examiner* — Jessee R Roe

(74) *Attorney, Agent, or Firm* — Abel Law Group, LLP

(57) ABSTRACT

A magnesium alloy is suitable for use as a corrodible downhole article, wherein the alloy includes: (a) 11-15 wt % Y, (b) 0.5-5 wt % in total of rare earth metals other than Y, (c) 0-1 wt % Zr, (d) 0.1-5 wt % Ni, and (e) at least 70 wt % Mg. It has been surprisingly found by the inventors that by increasing the Y content of the alloy to the range specified above, increased age hardening response and hence increased 0.2% proof stress can be achieved.

17 Claims, 1 Drawing Sheet

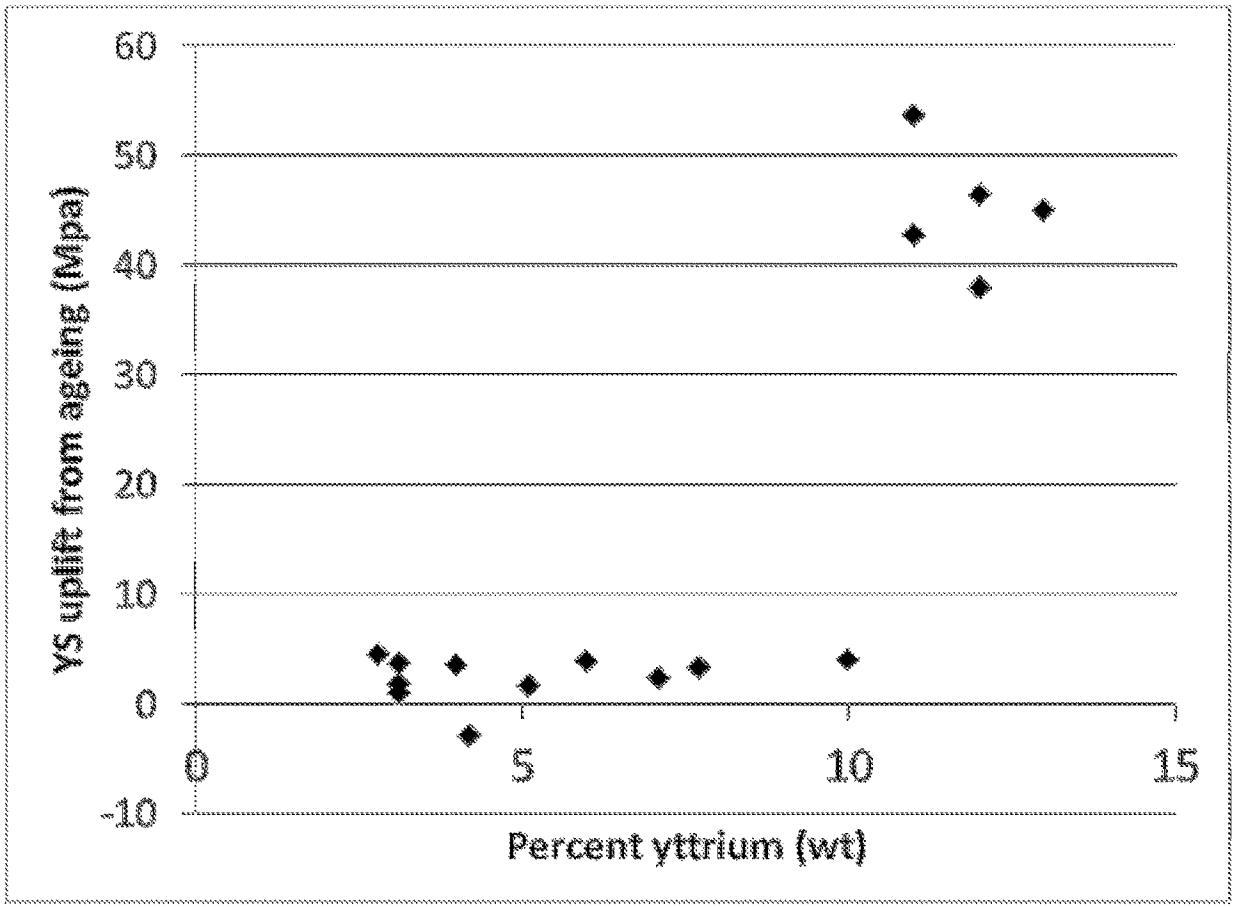
YS uplift from ageing (Mpa)
60
50
40
30
20
10
0
-10
0
5
10
15
Percent yttrium (wt)

CORRODIBLE DOWNHOLE ARTICLE

TECHNICAL FIELD

This disclosure relates to a magnesium alloy suitable for use as a corrodible downhole article, a method for making such an alloy, an article comprising the alloy and the use of the article.

BACKGROUND

The oil and gas industries utilise a technology known as hydraulic fracturing or "fracking". This normally involves the pressurisation with water of a system of boreholes in oil and/or gas bearing rocks in order to fracture the rocks to release the oil and/or gas.

In order to achieve this pressurisation, valves may be used to block off or isolate different sections of a borehole system. These valves are referred to as downhole valves, the word downhole being used in the context of the disclosure to refer to an article that is used in a well or borehole.

Downhole plugs are one type of valve. A conventional plug consists of a number of segments that are forced apart by a conical part. The cone forces the segments out until they engage with the pipe bore. The plug is then sealed by a small ball. Another way of forming such valves involves the use of spheres (commonly known as fracking balls) of multiple diameters that engage on pre-positioned seats in the pipe lining. Downhole plugs and fracking balls may be made from aluminium, magnesium, polymers or composites.

A problem with both types of valve relates to the strength of the material used to make them. An essential characteristic of the material is that it dissolves or corrodes under the conditions in the well or borehole. Such corrodible articles need to corrode at a rate which allows them to remain useable for the time period during which they are required to perform their function, but that allows them to corrode or dissolve afterwards.

The applicant's earlier patent application, GB2529062A, relates to a magnesium alloy suitable for use as a corrodible downhole article. This document discloses alloys containing 3.3-4.3 wt % Y, up to 1 wt % Zr, 2.0-2.5 wt % Nd and 0.2-7 wt % Ni which have corrosion rates of around 1100 mg/cm$^2$/day in 15% KCl at 93° C. (200 F). The alloys have a reasonable yield strength (around 200 MPa) and an elongation (ie ductility) of around 15%. However, the range of uses of these alloys are limited by their strength.

One known approach for strengthening magnesium alloys containing Y (and optionally a rare earth metal other than Y) is to use precipitation hardening or ageing to increase the yield strength of the alloy. For example, a T5 ageing process may be used. However, this approach is not effective for the super corroding alloys described in GB2529062A. This is thought to be due to the interference between the age hardening response and the alloy additions required to enhance the corrosion properties.

A material which provides the corrosion characteristics required for downhole valves, but with improved strength, has been sought.

SUMMARY OF THE DISCLOSURE

This disclosure relates to a magnesium alloy suitable for use as a corrodible downhole article, wherein the alloy comprises: (a) 11-15 wt % Y, (b) 0.5-5 wt % in total of rare earth metals other than Y, (c) 0-1 wt % Zr, (d) 0.1-5 wt % Ni, and (e) at least 70 wt % Mg. It has been surprisingly found by the inventors that by increasing the Y content of the alloy to the range specified above, increased age hardening response and hence increased 0.2% proof stress can be achieved.

In relation to this disclosure, the term "alloy" is used to mean a composition made by mixing and fusing two or more metallic elements by melting them together, mixing and re-solidifying them.

The term "rare earth metals" is used in relation to the disclosure to refer to the fifteen lanthanide elements, as well as Sc and Y.

It should be appreciated that in the magnesium alloys of this disclosure, the recited weight percentages of elements are based on a total weight of the composition and when combined equal 100%. Further, use of "comprising" transitional claim language does not exclude additional, unrecited elements or method steps. Moreover, the disclosure also contemplates use of "consisting essentially of" transitional claim language, which limits the scope of the claim to the specified materials or steps and those that do not materially affect the basic and novel characteristic(s) of the claimed invention which include a function of the composition as a corrodible downhole article, in particular, including increased age hardening response and hence increased 0.2% proof stress. When numerical ranges are used, the range includes the endpoints unless otherwise indicated.

Many features, advantages and a fuller understanding of the disclosure will be had from the accompanying drawings and the Detailed Description that follows. The following FIGURE is not intended to limit the scope of the disclosure claimed. It should be understood that the following Detailed Description describes the subject matter of the disclosure and presents specific embodiments that should not be construed as necessary limitations of the disclosed subject matter as set forth in the claims.

BRIEF DESCRIPTION OF THE DRAWINGS

FIG. 1 shows a graph of 0.2% proof stress uplift after ageing against Y content in wt %.

DETAILED DESCRIPTION

This disclosure relates to a magnesium alloy suitable for use as a corrodible downhole article, wherein the alloy comprises: (a) 11-15 wt % Y, (b) 0.5-5 wt % in total of rare earth metals other than Y, (c) 0-1 wt % Zr, (d) 0.1-5 wt % Ni, and (e) at least 70 wt % Mg.

Plugs made from the magnesium alloys of the disclosure can find a broader range of uses. In relation to fracking balls, one of the limitations in this product relates to the strength of the material. This is because, during the fracking process, hydraulic pressure tends to force the ball through the sliding sleeve seat. For correct functioning, this movement needs to be resisted by the mechanical integrity of the fracking ball. The increased strength (ie proof stress) provided by the magnesium alloys of the disclosure means that higher pressures can be applied, or a thinner seat designed.

In particular, the magnesium alloy may comprise Y in an amount of 11-14 wt %, more particularly in an amount of 11-13 wt %.

In particular, the magnesium alloy may comprise an amount of 1-3 wt % in total of rare earth metals other than Y, more particularly in an amount of 1.5-2.5 wt %, even more particularly in an amount of 1.6-2.3 wt %. More particularly, the rare earth metals other than Y may comprise Nd, even more particularly the rare earth metals other than Y may consist of Nd.

More particularly, the magnesium alloy may comprise Zr in an amount of up to 1.0 wt %. In particular, the magnesium alloy may comprise Zr in an amount of 0-0.5 wt %, more particularly in an amount of 0-0.2 wt %. In some embodiments, the magnesium alloy may comprise Zr in an amount of around 0.05 wt %. In some embodiments, the magnesium alloy may be substantially free of Zr.

In particular, the magnesium alloy may comprise Ni in an amount of 0.5-4 wt %, more particularly in an amount of 1.0-3.0 wt %, even more particularly in an amount of 1.2-2.5 wt %.

More particularly, the magnesium alloy may comprise Gd in an amount of less than 1 wt %, even more particularly less than 0.5 wt %, more particularly less than 0.1 wt %. In some embodiments, the magnesium alloy may be substantially free of Gd.

In particular, the magnesium alloy may comprise Ce (for example, in the form of mischmetal) in an amount of less than 1 wt %, even more particularly less than 0.5 wt %, more particularly less than 0.1 wt %. In some embodiments, the magnesium alloy may be substantially free of Ce.

More particularly, the remainder of the alloy may be magnesium and incidental impurities. In particular, the content of Mg in the magnesium alloy may be at least 75 wt %, more particularly at least 80 wt %.

A particularly preferred composition is a magnesium alloy comprising 11-13 wt % Y, 1.0-3.0 wt % of one or more rare earth metals other than Y, 0-0.2 wt % Zr, 1.0-3.0 wt % Ni and at least 80 wt % Mg.

In particular, the magnesium alloy may have a corrosion rate of at least 50 mg/cm$^2$/day, more particularly at least 75 mg/cm$^2$/day, even more particularly at least 100 mg/cm$^2$/day, in 3% KCl at 38° C. (100 F). In particular, the magnesium alloy may have a corrosion rate of at least 50 mg/cm$^2$/day, more particularly at least 250 mg/cm$^2$/day, even more particularly at least 500 mg/cm$^2$/day, in 15% KCl at 93° C. (200 F). More particularly, the corrosion rate, in 3% KCl at 38° C. or in 15% KCl at 93° C. (200 F), may be less than 15,000 mg/cm$^2$/day.

In particular, the magnesium alloy may have a 0.2% proof stress of at least 275 MPa, more particularly at least 280 MPa, even more particularly at least 285 MPa, when tested using standard tensile test method ASTM B557M-10. More particularly, the 0.2% proof stress may be less than 700 MPa. The 0.2% proof stress of a material is the stress at which material strain changes from elastic deformation to plastic deformation, causing the material to deform permanently by 0.2% strain.

In particular, the 0.2% proof stress of the magnesium alloy, after being subjected to an ageing process, may be at least 280 MPa, more particularly at least 300 MPa, even more particularly at least 320 MPa, when tested using standard tensile test method ASTM B557-10. More particularly, the 0.2% proof stress may be less than 800 MPa.

More particularly, the 0.2% proof stress of the magnesium alloy, after being subjected to an ageing process, may be at least 10 MPa higher than before the ageing process, even more particularly at least 25 MPa higher, more particularly at least 30 MPa higher, when tested using standard tensile test method ASTM B557-10.

In particular, the 0.2% proof stress of the magnesium alloy, after being subjected to an ageing process, may be at least 5% higher than before the ageing process, even more particularly at least 7.5% higher, more particularly at least 10% higher, when tested using standard tensile test method ASTM B557-10.

More particularly, the term "ageing process" is used to refer to a process in which the magnesium alloy is heated to a temperature above room temperature, held at that temperature for a period of time, and then allowed to return to room temperature (ie around 25° C.). In particular, the ageing processes referred to above may be a T5 ageing process. Such processes are known in the art and generally involve heating the magnesium alloy up to the ageing temperature (typically 150-250° C. for magnesium alloy), holding at that temperature for a period of time (typically 8-24 hours), and then allowing the alloy to return to room temperature. During this process the fine strengthening particles precipitate out inside the magnesium crystals. The ageing process may also be another heat treatment such a T6 treatment.

This disclosure also relates to a corrodible downhole article, such as a downhole tool, comprising the magnesium alloy described above. In some embodiments, the corrodible downhole article is a fracking ball, plug, packer or tool assembly. In particular, the fracking ball may be substantially spherical in shape. In some embodiments, the corrodible downhole article may consist essentially of the magnesium alloy described above.

This disclosure also relates to a method for producing a magnesium alloy suitable for use as a corrodible downhole article comprising the steps of:

(a) heating Mg, Y, at least one rare earth metal other than Y, Ni and optionally Zr to form a molten magnesium alloy comprising 11-15 wt % Y, 0.5-5 wt % in total of rare earth metals other than Y, 0-1 wt % Zr, 0.1-5 wt % Ni, and at least 70 wt % Mg, (b) mixing the resulting molten magnesium alloy, and (c) casting the magnesium alloy.

In particular, the method may be for producing a magnesium alloy as defined above. More particularly, the heating step may be carried out at a temperature of 650° C. (ie the melting point of pure magnesium) or more, even more particularly less than 1090° C. (the boiling point of pure magnesium). In particular, the temperature range may be 650° C. to 850° C., more particularly 700° C. to 800° C., even more particularly about 750° C. More particularly, in step (b) the resulting alloy may be fully molten.

The casting step normally involves pouring the molten magnesium alloy into a mould, and then allowing it to cool and solidify. The mould may be a die mould, a permanent mould, a sand mould, an investment mould, a direct chill casting (DC) mould, or other mould.

After step (c), the method may comprise one or more of the following additional steps: (d) extruding, (e) forging, (f) rolling, (g) machining.

The composition of the magnesium alloy can be tailored to achieve a desired corrosion rate falling in a particular range. The desired corrosion rate in 15% KCl at 93° C. can be in any of the following particular ranges: 50-100 mg/cm$^2$/day; 100-250 mg/cm$^2$/day; 250-500 mg/cm$^2$/day; 500-1000 mg/cm$^2$/day; 1000-3000 mg/cm$^2$/day; 3000-4000 mg/cm$^2$/day; 4000-5000 mg/cm$^2$/day; 5000-10,000 mg/cm$^2$/day; 10,000-15,000 mg/cm$^2$/day.

The method of the disclosure may also comprise tailoring compositions of the magnesium alloys, such that the cast magnesium alloys achieve desired corrosion rates in 15% KCl at 93° C. falling in at least two of the following ranges: 50 to 100 mg/cm$^2$/day; 100-250 mg/cm$^2$/day; 250-500 mg/cm$^2$/day; 500-1000 mg/cm$^2$/day; 1000-3000 mg/cm$^2$/ day; 3000-4000 mg/cm$^2$/day; 4000-5000 mg/cm$^2$/day; 5000-10,000 mg/cm$^2$/day; and 10,000-15,000 mg/cm$^2$/day.

This disclosure also relates to a magnesium alloy suitable for use as a corrodible downhole article which is obtainable by the method described above.

In addition, this disclosure relates to a magnesium alloy as described above for use as a corrodible downhole article.

This disclosure also relates to a method of hydraulic fracturing comprising the use of a corrodible downhole article comprising the magnesium alloy as described above, or a downhole tool as described above. In particular, the method may comprise forming an at least partial seal in a borehole with the corrodible downhole article. The method may then comprise removing the at least partial seal by permitting the corrodible downhole article to corrode. This corrosion can occur at a desired rate with certain alloy compositions of the disclosure as discussed above. More particularly, the corrodible downhole article may be a fracking ball, plug, packer or tool assembly. In particular, the fracking ball may be substantially spherical in shape. In some embodiments, the fracking ball may consist essentially of the magnesium alloy described above.

The disclosure will now be described by reference to the following Examples which are presented to better explain particular aspects of the disclosure and should not be used to limit the subject matter of this disclosure as defined in the claims.

Examples

Magnesium alloy compositions were prepared by combining the components in the amounts listed in Table 1 below (the balance being magnesium and incidental impurities). These compositions were then melted by heating at 750° C. The melt was then cast into a billet and extruded to a rod.

TABLE 1

| | Chemistry (wt %) | | | | | 0.2% proof stress (MPa) | | Ageing |
|---|---|---|---|---|---|---|---|---|
| Example number | Y | Ni | Zr | RE | RE Type | As extruded | T5 aged | uplift (MPa) |
| 1* | 2.8 | 1.4 | 0.05 | 5 | Gd | 202 | 206 | 5 |
| 2* | 3.1 | 1.6 | 0.05 | 1.8 | Gd | 179 | 181 | 2 |
| 3* | 3.1 | 1.4 | 0.05 | 3.7 | Gd | 201 | 202 | 1 |
| 4* | 3.1 | 1.4 | 0.05 | 3.7 | Gd | 186 | 190 | 4 |
| 5* | 4 | 1.3 | 0.05 | 4.6 | Gd | 209 | 212 | 4 |
| 6* | 4.2 | 1.5 | 0.05 | 2.7 | Nd & Gd | 197 | 194 | −3 |
| 7* | 5.1 | 1.6 | 0.05 | 0.4 | Nd | 186 | 188 | 2 |
| 8* | 6 | 1.4 | 0.05 | 0.3 | Nd | 185 | 188 | 4 |
| 9* | 7.1 | 1.3 | 0.05 | 0.3 | Nd | 209 | 211 | 2 |
| 10* | 7.7 | 1.2 | 0.05 | 0.3 | Nd | 231 | 234 | 3 |
| 11* | 10 | 1.4 | 0.05 | 2.2 | Nd | 268 | 272 | 4 |
| 12 | 11 | 1.6 | 0.05 | 2 | Nd | 302 | 345 | 43 |
| 13 | 11 | 1.6 | 0.05 | 2 | Nd | 293 | 347 | 54 |
| 14 | 12 | 1.4 | 0.05 | 1.7 | Nd | 313 | 360 | 46 |
| 15 | 12 | 1.4 | 0.05 | 1.7 | Nd | 332 | 370 | 38 |
| 16 | 13 | 2.2 | 0 | 2.2 | Nd | 314 | 359 | 45 |

*Comparative examples

This data clearly shows that the examples of the disclosure (ie Examples 12-16), having higher levels of Y, surprisingly show a significantly better increase in 0.2% proof stress (as tested according to ASTM B557M-10) after ageing. This is confirmed by viewing this data in the form of the graph of FIG. 1.

Many modifications and variations of the disclosed subject matter will be apparent to those of ordinary skill in the art in light of the foregoing disclosure. Therefore, it is to be understood that, within the scope of the appended claims, the disclosed subject matter can be practiced otherwise than has been specifically shown and described.

The invention claimed is:

1. A magnesium alloy suitable for use as a corrodible downhole article, wherein the alloy comprises:
(a) 11-15 wt % Y,
(b) 1.5-5 wt % in total of rare earth metals other than Y, wherein Gd is less than 0.5 wt %,
(c) 0-1 wt % Zr,
(d) 0.1-5 wt % Ni, and
(e) at least 70 wt % Mg.

2. A magnesium alloy as claimed in claim 1 comprising 11-14 wt % Y.

3. A magnesium alloy as claimed in claim 1 comprising up to 2.5 wt % in total of said rare earth metals other than Y.

4. A magnesium alloy as claimed in claim 1 comprising 0-0.2 wt % Zr.

5. A magnesium alloy as claimed in claim 1 comprising 1.0-3.0 wt % Ni.

6. A magnesium alloy as claimed in claim 1 comprising at least 75 wt % Mg.

7. A magnesium alloy as claimed in claim 1 having a corrosion rate of at least 50 mg/cm$^2$/day in 15% KCl at 93° C.

8. A magnesium alloy as claimed in claim 1 having a 0.2% proof stress of at least 275 MPa when tested using standard tensile test method ASTM B557-10.

9. A magnesium alloy as claimed in claim 1 having a 0.2% proof stress, after being subjected to an ageing process, of at least 280 MPa when tested using standard tensile test method ASTM B557-10.

10. A magnesium alloy as claimed in claim 9, wherein the ageing process is a T5 ageing process.

11. A magnesium alloy as claimed in claim 9, wherein the ageing process is a T6 ageing process.

12. A downhole tool comprising a magnesium alloy as claimed in claim 1.

13. A method for producing a magnesium alloy as claimed in claim 1, comprising the steps of:
(a) heating Mg, Y, at least one rare earth metal other than Y, optionally Gd, Ni and optionally Zr to form a molten magnesium alloy comprising 11-15 wt % Y, 1.5-5 wt % in total of rare earth metals other than Y, wherein Gd is less than 0.5 wt %, 0-1 wt % Zr, 0.1-5 wt % Ni, and at least 70 wt % Mg,
(b) mixing the resulting molten magnesium alloy, and
(c) casting the magnesium alloy.

14. A method of hydraulic fracturing comprising inserting a downhole tool as claimed in claim 12 into a borehole.

15. A magnesium alloy as claimed in claim 1 having a 0.2% proof stress, after being subjected to an ageing process, which is at least 10 MPa higher than before the ageing process when tested using standard tensile test method ASTM B557-10.

16. A magnesium alloy as claimed in claim 1 having a 0.2% proof stress, after being subjected to an ageing process, which is at least 5% higher than before the ageing process when tested using standard tensile test method ASTM B557-10.

17. A magnesium alloy suitable for use as a corrodible downhole article, wherein the alloy comprises:
(a) 11-15 wt % Y,
(b) 0.5-5 wt % Nd, (c) 0-1 wt % Zr,
(d) 0.1-5 wt % Ni, and
(e) at least 70 wt % Mg.

* * * * *